US005983871A

United States Patent [19]

Gordon et al.

[11] Patent Number: 5,983,871

[45] Date of Patent: Nov. 16, 1999

[54] IGNITION SYSTEM FOR AN INTERNAL COMBUSTION ENGINE

[76] Inventors: Eugene Gordon, 4v Tsentralnaya, Apt. 19, Chernogolovka, Moscow Region, Russian Federation, 142432; Alexander Shteinberg, 275 Hawthorne Ave. #212, Palo Alto, Calif. 94301; Yuri Moskvin, 18 Shkolnyi Boulevard, Apt. 218 Chernogolovka; Vladislav Zelenov, 4v Tsentralnaya, Apt. 3 Chernogolovka, both of Moscow, Russian Federation, 142432

[21] Appl. No.: 08/966,640

[22] Filed: Nov. 10, 1997

[51] Int. Cl.[6] ..... F02P 23/04

[52] U.S. Cl. ..... 123/536; 123/143 B

[58] Field of Search ..... 123/143 B, 536, 123/606

[56] References Cited

U.S. PATENT DOCUMENTS

| | | | |
|---|---|---|---|
| 3,934,566 | 1/1976 | Ward | 123/143 B X |
| 4,138,980 | 2/1979 | Ward | 123/143 B X |
| 4,297,983 | 11/1981 | Ward | 123/536 |
| 4,416,226 | 11/1983 | Nishida et al. | 123/143 B |
| 4,499,872 | 2/1985 | Ward et al. | 123/536 X |
| 4,556,020 | 12/1985 | Hickling | 123/143 B |
| 5,756,924 | 5/1998 | Early | 123/143 B X |

*Primary Examiner*—Tony M. Argenbright

[57] ABSTRACT

The invention relates to an ignition system for an internal combustion engine (ICE) that provides fast transfer from a laminar combustion in an ignition kernel to a self-sustaining turbulent flame propagation, thus leading to a reduction in the total time of combustion. The effect is achieved by transiently attacking the ignition kernel with a high-frequency (HF) electromagnetic radiation pulse, which is quasiperiodically modulated with 10–1000 kHz frequency in the initial period of combustion (50–500 $\mu$s) following the ignition. Radiation is absorbed by electrons existing only inside the ignition kernel during the initial stage of its development. Due to thermal inertia, the medium perceives the oscillations on the frequency of modulation, whereby the surface of the kernel is developed and is split into separate fractions. This causes transfer from laminar to turbulent bulk combustion. The technique proposed is of an especially great importance for a lean-burn ICE which is normally characterized by low combustion temperature and hindered transition to turbulent flame propagation.

38 Claims, 9 Drawing Sheets

IGNITION SYSTEM FOR AN INTERNAL COMBUSTION ENGINE

BACKGROUND—FIELD OF THE INVENTION

This invention relates to ignition systems of combustible gaseous mixtures, in particular to ignition systems for internal combustion engines.

BACKGROUND—PRINCIPLE OF IGNITION AND COMBUSTION OF COMBUSTIBLE GASEOUS MIXTURES

It is known that one of the fundamental parameters of combustion is a laminar flame velocity $V_1$ which depends mainly on the final temperature of burning T*. For a hydrocarbon-air (oxygen) mixture, the aforementioned dependence can be expressed by the following empirical formula (see "The Combustion" by S. Kumagai, "Khimiya" Publishers, Moscow, 1979):

$$V_1=8\times10^{5(1-2000/T^*)}\ \text{cm/s} \quad (1).$$

It is also known that for normal operation of an internal combustion engine (ICE), the flame propagation velocity $V_{pr}$ should be 300 times as high as $V_1$. In order to increase the flame propagation velocity, it is necessary to develop the surface of combustion, and this, in turn, can be achieved by powerful turbulization of the flame front. For example, in lean mixtures which, when burnt in ICE are characterized by high thermal efficiency and low nitrogen oxide ($NO_x$) emission which pollutes the atmosphere, the $V_1$ value is as low as 10 cm/s. On the other hand, drivability of ICE requires that the flame propagation velocity $V_{pr}$ be of about 30 m/s. Therefore the developed turbulence has to be so large-scale that an overall surface of the burning zones would exceed the piston head area by a factor of $V_{pr}/V_1=300$. Thus, in studying conditions of combustion in an ICE, it is expedient to consider the combustion front not merely as a continuous rough surface but rather as a variety of segregated flame zones.

In a steady-state turbulent combustion the flame generates the necessary vorticity itself, and its velocity $V_{pr}$, which does not depend on ignition fashion, is defined exclusively by thermodynamics and gas dynamics of the mixture as well as by the combustion chamber geometry. On the other hand, just after spark ignition, a combustion always is laminar, i.e., slow, and it costs a lot of time for the flame velocity to increase up to the level of $V_{pr}$. Thus, a process of combustion in an ICE always consists of two stages, i.e., an initial slow stage and a final fast self-sustaining turbulent stage.

It should be noted that the existence of the first slow stage of combustion does not allow the engine to rotate with a speed higher than a certain critical value which is about 6000 rpm. Therefore, in order to match the speed of a vehicle with the speed of rotation of the engine camshaft, it is necessary to use huge gear boxes, which make the construction of the vehicle more complicated and heavy.

Thus, it can be concluded from the above that in order to increase efficiency of combustion and to reduce pollution of the atmosphere with nitrogen oxides contained in exhaust gases, it is advantageous to shorten the aforementioned initial slow stage by accelerating transition to the turbulent stage of combustion.

DESCRIPTION OF THE PRIOR ART

Attempts have been made heretofore to solve the aforementioned problem of accelerated combustion in an ICE. In general, the methods on which these attempts are based can be summarized as described below.

(1) One of the methods is known as a space-time optimization of the ignition, which essentially is an optimization of the positions and number of spark plugs, as well as of the ignition advance [see, e.g., Fuel Economy in Road Vehicles Powered by Spark Ignition Engines by J. C. Hilliard and G. S. Springer, Plenum Press, New York—London, 1984].

(2) Another method is based on the use of electrical spark ignition. This method, in turn, can be subdivided as follows:

(a) A method based on the generation of power shock waves by low-induction electrical breakdown of short duration in igniters [see, e.g., 17th Symp. (Internat.) on Combustion by R. Maky and M. Vogel, The Comb. Inst., p. 821, 1977].

(b) A method based on an increase of ignition energy and generation of a turbulent plasma plume (i.e., plasma torch) in plasma-jet and surface discharge igniters of plasma [see, e.g., J. Phys. D: Appl. Phys. by P. R. Smy, et al., 18, p. 827, 1985].

(c) A method based on ignition of a lean mixture by a turbulent flame of a more rich mixture in a precombustion chamber igniter [see, e.g., Combust. Sci. Technol. by P. L. Pitt, et al., 35, p. 277, 1984].

Most of the igniters of the types mentioned in items (1) and (2) are electric discharge devices which introduce energy into the mixture via electrons generated during the breakdown, and the number of electrons is self-sustained at a level high enough to transform all stored electric energy into heat.

Analysis of the igniters described in items (1) and (2) (a), (b), (c) and their comparison in terms of energy release and volume of the ignition kernel shows that the precombustion chamber igniters are most suitable for ignition of lean mixtures. However, although the igniters of the precombustion chamber type to some extent shorten the burning time of the combustible mixture, and the effect of this shortening is insignificant and practically does not allow to essentially shorten the laminar stage of combustion.

Plasma-jet igniters also look promising from the view point of shortening the burning time, but they have an essential disadvantage which consists of erosion of electrodes caused by energy of ignition (about 1 J).

(3) Another approach which has been recently proposed for the solution of the above problem is based on a laser-assisted ignition which consists of replacing an electric spark with a laser spark [see, e.g., U.S. Pat. No. 4,416,226 issued in 1983 to M. Nishida].

The laser method needs to be described in more detail as it may be a promising new technique for ignition systems in the future. There are few works concerning laser-based ignition of flammable gases [Laser Versus Conventional Ignition Flames by P. D. Ronney, Optical Engineering, February 1994, Vol. 33, No 2, p. 510–521].

An evident important advantage of laser ignition consists in that the ignition point or a set of points can be arranged in any desired place within the combustion chamber. Another advantage is that the duration and the energy of the initiating action can be easily controlled by a computer. It is worthy of noting that efficiency, resources, and reliability of the present-day lasers are high enough to satisfy all demands placed upon spark plugs of an ICE. Moreover, the introduction of a laser beam into the cylinder (including a multi-point case) seems to be a much less complicated problem than the use of any other means of external influence.

Provided the number of electrons is sufficient for the absorption of the laser light, the process of ignition will depend on the consumption of energy in the same manner as in the case of the electric ignition. But contrary to a conventional electrical discharge ignition, the number of electrons developed in a laser ignition system is not sufficient for effective absorption of laser energy. This is because the fuel used in ICE is optically transparent for the radiation of a conventional laser. Consequently electrons can be generated only under conditions of multiphoton ionization with the rate proportional to $I^n$ where I is the intensity of the laser beam and n is a power which exceeds 2. For lasers with a pulse duration $\tau_1$ exceeding 10 nsec, such a condition is satisfied only when the laser energy which is equal to $I \times \tau_1$ is far in excess of the energy required for ignition. Therefore combustion transverses directly to detonation, and this is undesired for the normal operation of an ICE. That is why a laser ignition system of the type described in U.S. Pat. No. 4,416,226 as well as any other known laser ignition system based on the use of 10 to 100 nsec pulse duration did not find practical application.

As known from the literature [Laser Versus Conventional Ignition Flames by P. D. Ronney, Optical Engineering, February 1994, Vol. 33, No. 2, p. 510–521] and as has been found in experiments conducted by the applicants [Report 86X-SP500V: Experimental Study of Laser Spark Ignition of Fuel-Oxygen (Air) Mixtures and Development of Theoretical Approach by E. B. Gordon, et. al., Russian Academy of Sciences, Moscow, Russia, 1995], the above problem may be overcome by using picosecond-pulse lasers.

In the case of a laser-induced near-wall gas breakdown, the seed electrons are effectively generated by the surface electron emission so that this stage becomes non-limiting, and laser ignition can be easily achieved with nanosecond pulses as well.

Alternative method for achieving an efficient laser ignition is an addition of a small amount of special additives to a combustible mixture. Such additives may be represented by organic molecules of a large cross section of two- or three-photon absorption. This is necessary for initiating bulk ignition in a small volume by laser beam focusing.

All decisions mentioned in item (3) allow, in principle, a usual spark ignition to be replaced by a laser one, benefiting in this case from (i) an ignition reliability and possible control of the ignition kernel parameters, and (ii) 1.5–2 fold reduction of a combustion front path. However, as it has already noted, the main time of a charge burning is defined by the laminar combustion stage in the vicinity of the ignition point. Therefore the total time of a charge burning can be changed neither a single-point ignition nor by a multipoint one.

(4) Still another method possible for the solution of the problem associated with acceleration of combustion is the use of microwave (MW) radiation. However, it is known that because of the large wavelength, the MW energy cannot be focused in a small spot, and therefore a higher energy consumption is required for ignition of the combustible mixture. Nevertheless, since the MW emission can be locally absorbed by electrons, its application in combination with the conventional electron-generating discharge or laser point ignition may be promising.

Ward et al. (see M. A. V. Ward et al, U.S. Pat. No. 4,499,872) show theoretically and in model experiments that microwave radiation may be effectively introduced into combustion chamber which, in this case, acts as an MW cavity. Microwave radiation promotes ignition of lean-burn mixtures and accelerates a flame propagation (M. A. V. Ward//J. of Microwave Power, 1980, 15(3), p. 193–202). However, the use of microwave pumping for a flame over the entire cycle of operation, as it is proposed by M. A. V. Ward et al. in U.S. Pat. No. 4,499,872 needs a combustion chamber of a special configuration. This is necessary for preventing a significant shift in the cavity resonant frequency caused by reciprocating movements of the piston that constitutes one of the walls of the MW cavity. Moreover, since a Q-factor of the cavity is not so high, low concentration of electrons at a steady flame front leads to low efficiency of microwave energy absorption by these electrons. Thus, a significant part of the chemical energy released during the cycle is to be spent for generation of microwave oscillations.

There is one more crucial disadvantage in the aforementioned approach, as well as in any other known attempt of improving the propagation of flame in an ICE. This disadvantage will now be explained. More specifically, due to large excess of oxygen and particularly nitrogen in any air-fuel mixture, the only important difference between rich and lean mixtures (in terms of the ICE efficiency, quality of exhaust gases and velocity of flame propagation) is a 200–300° C. difference in the final temperature of burning. Meanwhile, abundant evidence has shown that any external action affects abovementioned characteristics to the same extent as it increases the final gas temperature. It means that any such influence on lean mixture brings us back to all disadvantages inherent in a rich mixture.

As a result, it appears that the final temperature of gas can be increased in a more simple and less expensive way by additional fuel consumption rather than by transforming chemical energy into other forms and then spending it on heating the burning mixture.

Thus, it can be summarized that the existing ignition systems of any type used in ICE are unable to solve the main problem, i.e., to improve performance of ICE on lean-burn mixtures without worsening other characteristics for the sake of which the transition to lean mixtures is performed.

OBJECTS OF THE INVENTION

It is an object of the present invention to provide an ignition system for an internal combustion engine (ICE) which is simple in construction, reliable in operation, and inexpensive to manufacture.

Another object is to ensure fast transfer from a laminar combustion in an ignition kernel to a turbulent flame propagation and to improve performance of internal combustion engines on lean-burn mixtures without worsening any other characteristics inherent in such engines.

Other advantages and features of the present invention will become more clearly understood after the consideration of the ensuing description with the attached drawings.

SUMMARY OF THE INVENTION

The invention relates to an ignition system for an internal combustion engine (ICE) that provides fast transfer from a laminar combustion in an ignition kernel to a self-sustaining turbulent flame propagation, thus leading to a reduction in the total time of combustion. The effect is achieved by transiently attacking the ignition kernel with a high-frequency (HF) electromagnetic radiation pulse, which is quasiperiodically modulated with 10–1000 kHz frequency in the initial period of combustion (50–500 $\mu$s) following the ignition. Radiation is absorbed by electrons existing only inside the ignition kernel during the initial stage of its development. Due to thermal inertia, the medium perceives the oscillations on the frequency of modulation, whereby the surface of the kernel is developed and is split into separate fractions. This causes transfer from laminar to turbulent bulk combustion. The technique proposed is of an especially great importance for a lean-burn ICE which is normally characterized by low combustion temperature and hindered transition to turbulent flame propagation.

DESCRIPTION OF THE PREFERRED EMBODIMENTS

Figure 1:
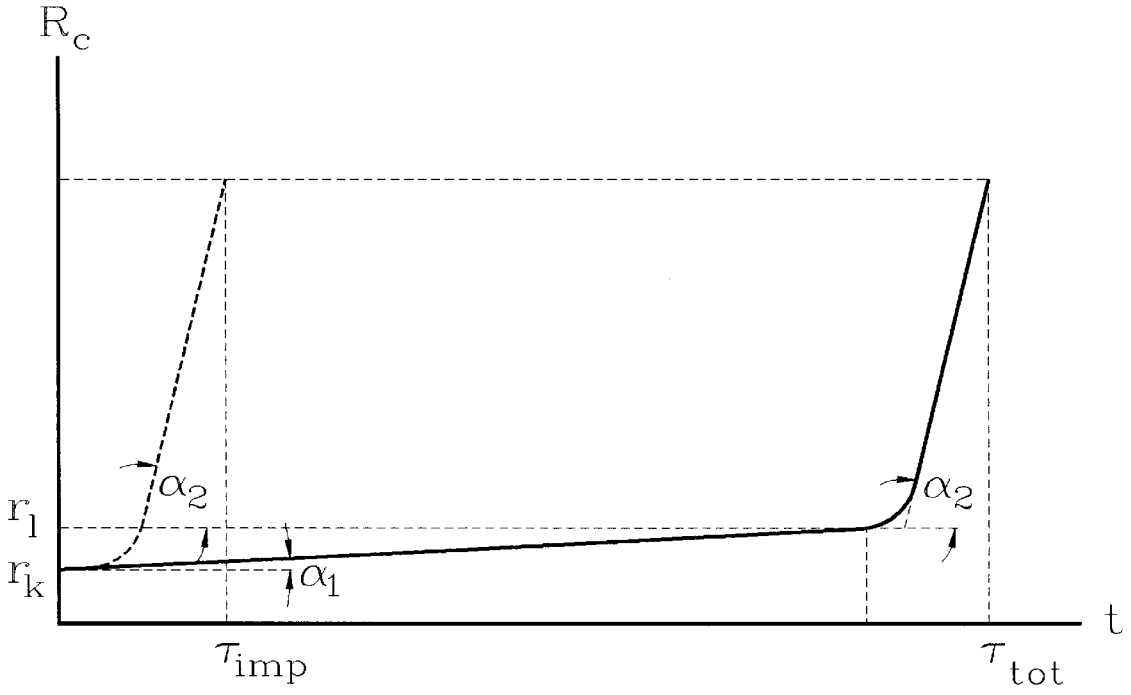
FIG. 1 is a graph illustrating a two-stage process of combustion inside a combustion chamber of a conventional ICE.

A two-stage process of combustion inside a cylinder of ICE can be more clearly understood with reference to FIG. 1 which is a graph illustrating a dependence of the flame front position on time. In this graph, the time t is plotted on an abscissa axis and the flame front position I is plotted on the ordinate axis. During the first stage a laminar flame propagates for a short distance from initial radius $r_k$ equal to about 1 mm up to radius $r_l$ equal approximately to several $r_k$. But this stage lasts along time $\tau_l$ because of low velocity $V_1=\mathrm{tg}\alpha_1=10$ cm/s. In spite of the fact that only 0.1% of the total volume of a combustible mixture is burned during the first stage, the time $\tau_l$ in a great extent defines the total time of the charge burning. During the second stage the self-sustaining turbulent combustion proceeds with the velocity $V_{pr}=\mathrm{tg}\alpha_2=30$ m/s and the flame dimension increases up to the inner radius $R_c$ of the combustion chamber.

The main idea of the invention is to reduce the total time $\tau_{tot}$ of burning by shortening the slow initial stage of laminar combustion by causing externally stimulated disintegration of ignition kernel, thus leading to early transition to a turbulent flame. In FIG. 1, this is shown as a parallel shift of the start point of the second stage toward the origin of coordinates. The time difference $\tau_{tot}-\tau_{imp}$ represents saving of the combustion time as a whole.

Figure 2:
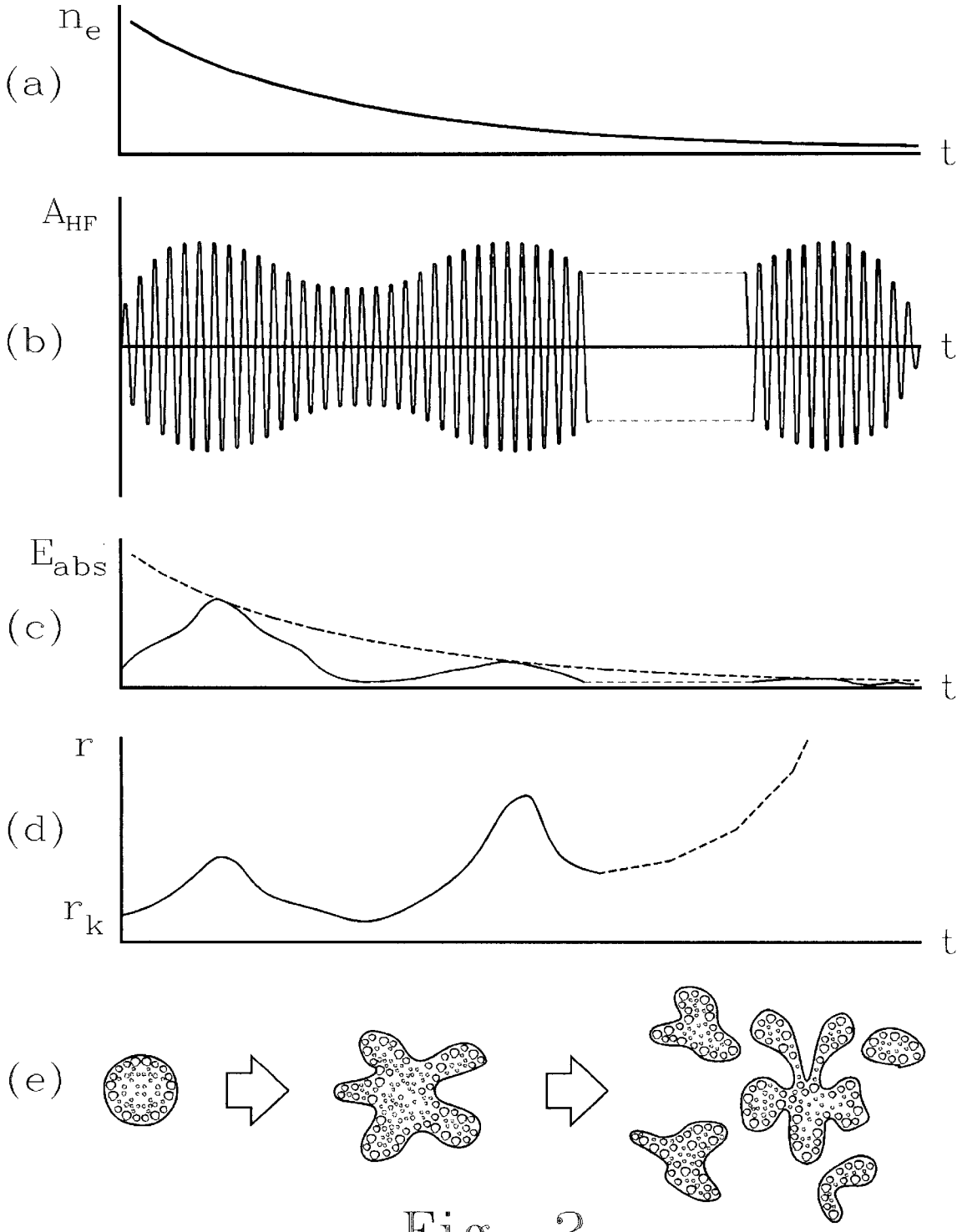
FIG. 2 represents the time charts necessary for the explanation of the improvement offered by the invention.

FIG. 2 illustrates the development of the turbulence in the ignition kernel promoting to the end the kernel splitting to topological separated ignition cores.

The electric discharge or laser breakdown is followed by the generation of electrons in the kernel with an electron density $n_e$ decreasing in time, due to their recombination, from $10^{18}$ $cm^{-3}$ at the moment of breakdown to $10^{11}$ $cm^{-3}$ within first 100 $\mu$s of the burning time. This decrease is inversely proportional to the time. This is shown in FIG. 2*a* where time t is plotted on the axis of abscissas and electron concentration $n_e$ is plotted on the axis of ordinates. A high-frequency (HF) electromagnetic field (microwave or laser) with an amplitude quasiperiodically modulated with the 10–1000 kHz frequency and introduced into the combustion chamber just within 50–500 $\mu$s after ignition, is absorbed only by the aforementioned electrons, whereas the remaining volume of the combustion chamber is left transparent to HF radiation. The mode of modulation is shown in FIG. 2*b*, where time t is plotted on the axis of abscissas and frequency modulated amplitude $A_{HF}$ is plotted on the axis of ordinates.

Thermal inertia of the medium smoothes the HF action, and the ignition kernel perceives ultrasonic oscillations at the modulation frequency. In order to ensure effective splitting of the ignition kernel and promote accelerated combustion, it is required that the modulation frequency or the frequency combination be program-controlled to be close to the frequency of the kernel shape instability that is defined by the type of the engine, operating conditions, and characteristics of the mixture to be combusted in the engine.

Temporal fine tuning of the amplitude modulation parameters of HF electromagnetic energy should be program-controlled by means of a computer to achieve the maximal output power developed by the engine. For an engine of a specific type and for specific operating conditions, as well as for the purposes of research, development and testing, an optimal parametric function required for such tuning may be determined experimentally, e.g., by means of a bench test system that incorporates the aforementioned computer. For commercial ICMs, this optimal function which has been obtained experimentally may be inputted directly into the control system of the vehicle, e.g., into an on-board computer incorporated into the aforementioned control system.

For example, the following simplest two-parametric A, $\alpha$ function of the amplitude modulation of HF electromagnetic energy could be used:

$$A_{HF}=A\cdot\exp\,(i\cdot\omega\cdot t);\omega=\omega(\alpha;t) \quad (2),$$

where A is the HF field strength amplitude, $\omega$ is the frequency of the kernel shape instability (since this frequency depends on the ignition kernel dimension, $\omega$ is a time-dependent function). In the first approximation which would be sufficient for reliable parametric description ( see, e.g., "Hydrodynamics" by L. D. Landau, and E. M. Lifshits, Publishers Moscow, 1988, P. 381)

$$\omega=\alpha\cdot(1+(V_1t/r_k))^{-1} \quad (3),$$

where the variable $\alpha$ is numerically equal to the frequency of the initial kernel (having radius $r_k$) shape instability and $V_1$ is a laminar flame propagation velocity.

Initially the tuning of the modulation function (2) to the maximum output power developed by the engine is carried out by varying the parameter $\alpha$ at a fixed A value, until an optimum value $\alpha_{opt}$ is obtained. Then at $\alpha=\alpha_{opt}$ the value of A is increased until the output power $P_{out}$ will not depend essentially on A.

A favorable effect of ultrasonic frequencies on the acceleration of a laminar flame propagation is well known from literature (see, e.g., "The Combustion" by S. Kumagai, "Khimiya" Publishers Moscow, 1979). In the system proposed by Kumagai the entire combustion chamber is irradiated with acoustic waves. However, routine application of acoustic waves as Kumagai did is inefficient because these waves are absorbed by the whole bulk of a combustion chamber without any preference of the ignition kernel.

In contrast to known methods used for intensification of flame propagation, the system of the present invention utilizes electromagnetic emission which is absorbed only by electrons inside the ignition kernel and causes acoustic vibration of the kernel due to local heating of the latter. However, if one would offer to use the electromagnetic radio-frequency emission of the range of interest, 10–1000 kHz, its absorption by a small amount of electrons, presented in the kernel, will be very low. Only by using the HF carrier of radio-frequency one can localize the power absorption directly inside the ignition kernel, with the efficiency directly proportional to the electron concentration $n_e$ and to the square of the HF field strength amplitude: $E_{abs} \sim n_e \times A^2_{HF}$. This is shown in FIG. 2*c*, where time t is plotted on the axis of abscissas and the absorbed HF energy $E_{abs}$ is plotted on the axis of ordinates. The thermally induced breathing pulsation of the ignition kernel deforms its shape and leads to a kernel instability up to its splitting into topological separated burned fractions which are necessary for the turbulent bulk combustion. This is shown in FIGS. 2*d* and 2*e*, where FIG. 2*d* shows temporal variation of the combustion zone dimensions "r", and FIG. 2*e* shows sequential stages of splitting of the kernel into topologically independent parts.

Figure 3:
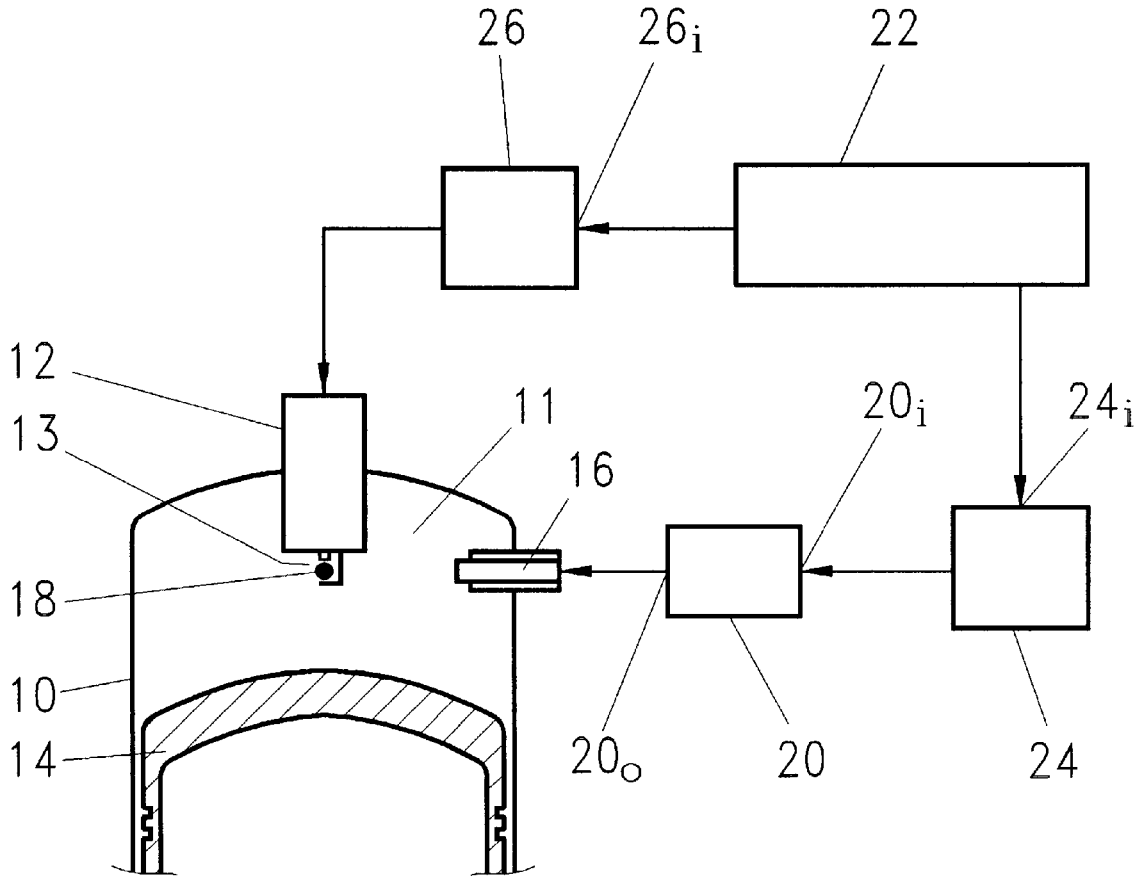
FIG. 3 is a general block-diagram of an ICE ignition system of the invention that combines an electrical spark ignition with MW pumping.
Figure 4:
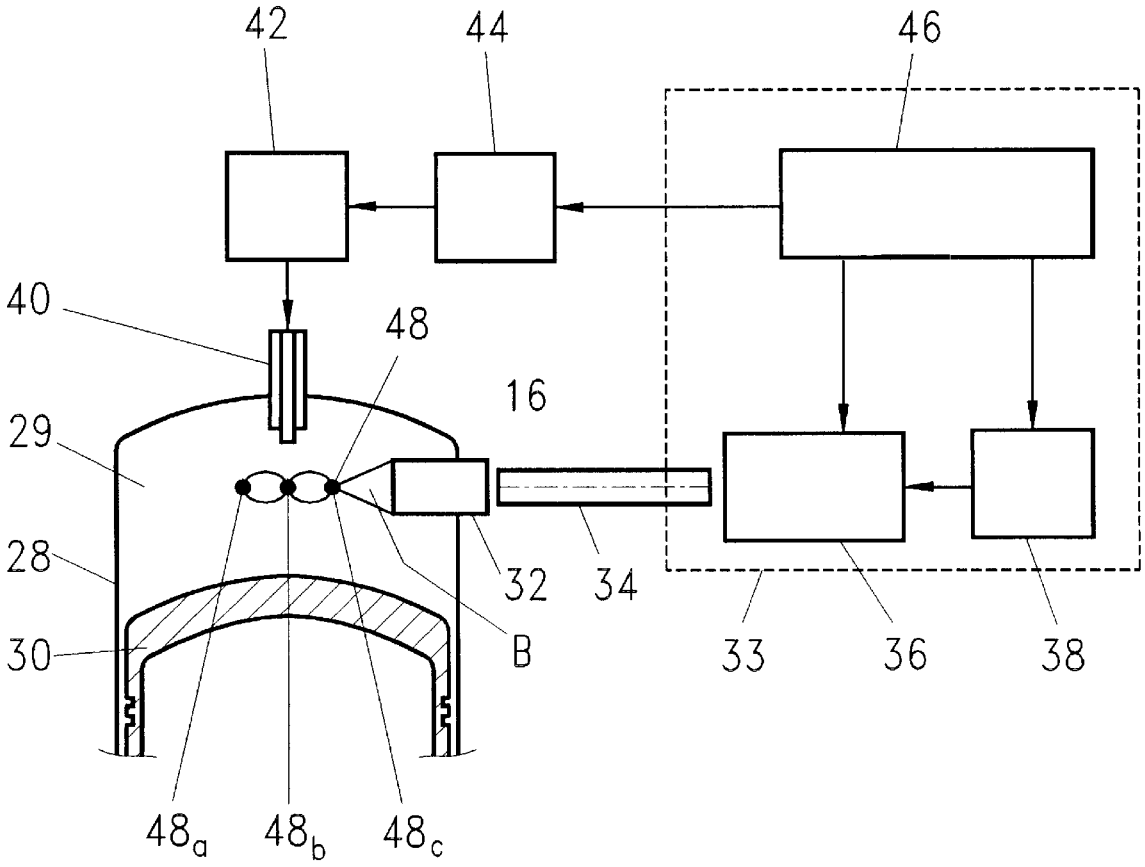
FIG. 4 is a general block-diagram of an ICE ignition system of the invention that combines a laser spark ignition with MW pumping.
Figure 5:
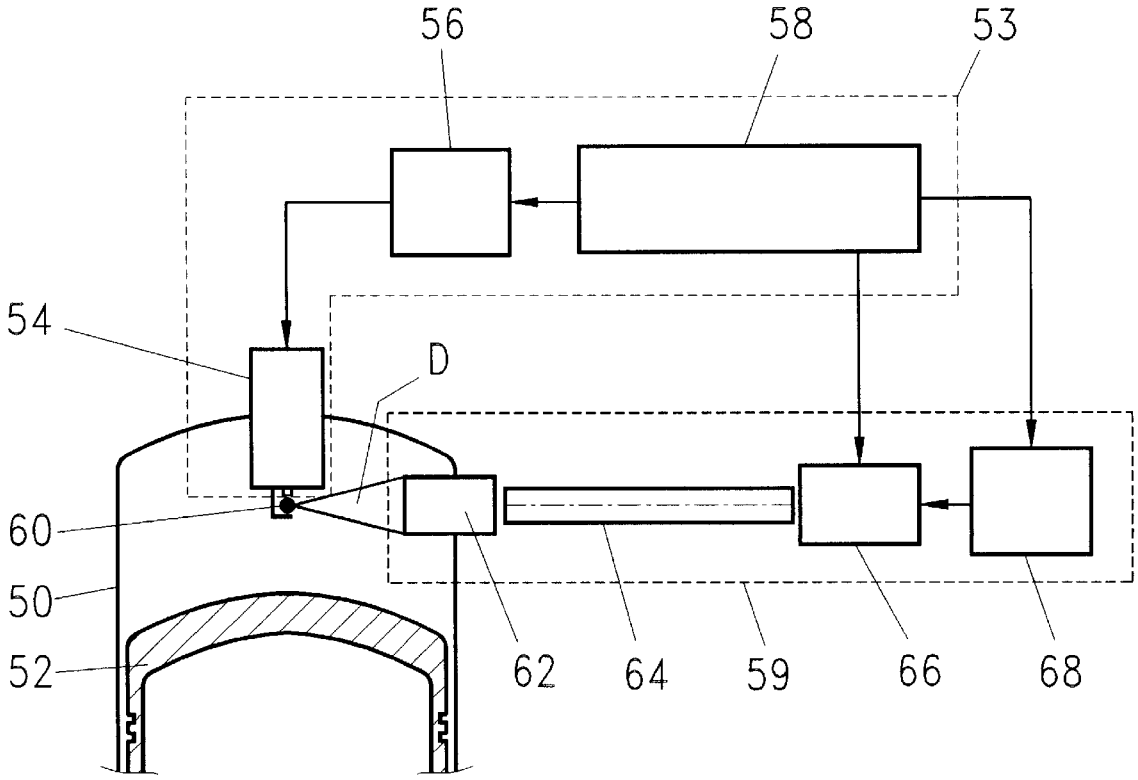
FIG. 5 is a general block-diagram of an ICE ignition system of the invention that combines an electrical spark ignition with laser pumping.
Figure 6:
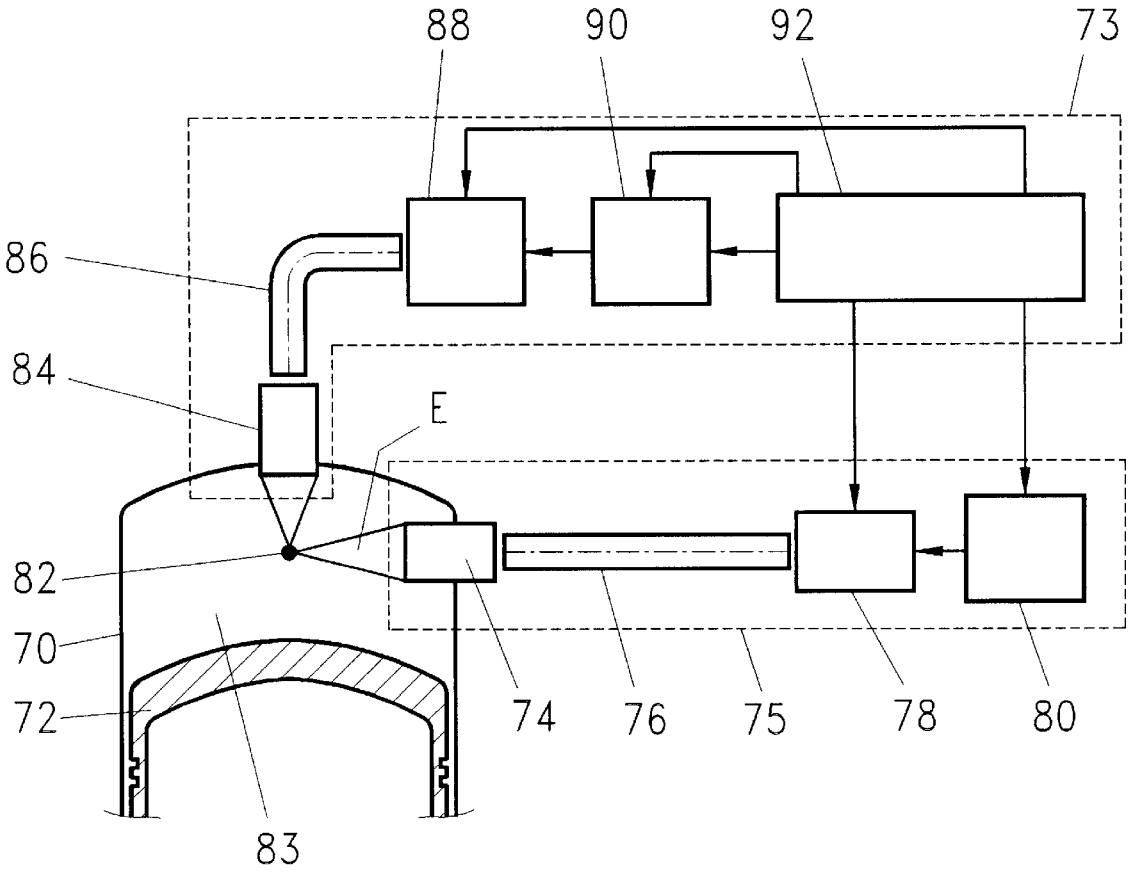
FIG. 6 is a general block-diagram of an ICE ignition system of the invention that combines a laser spark ignition with laser pumping.
Figure 7:
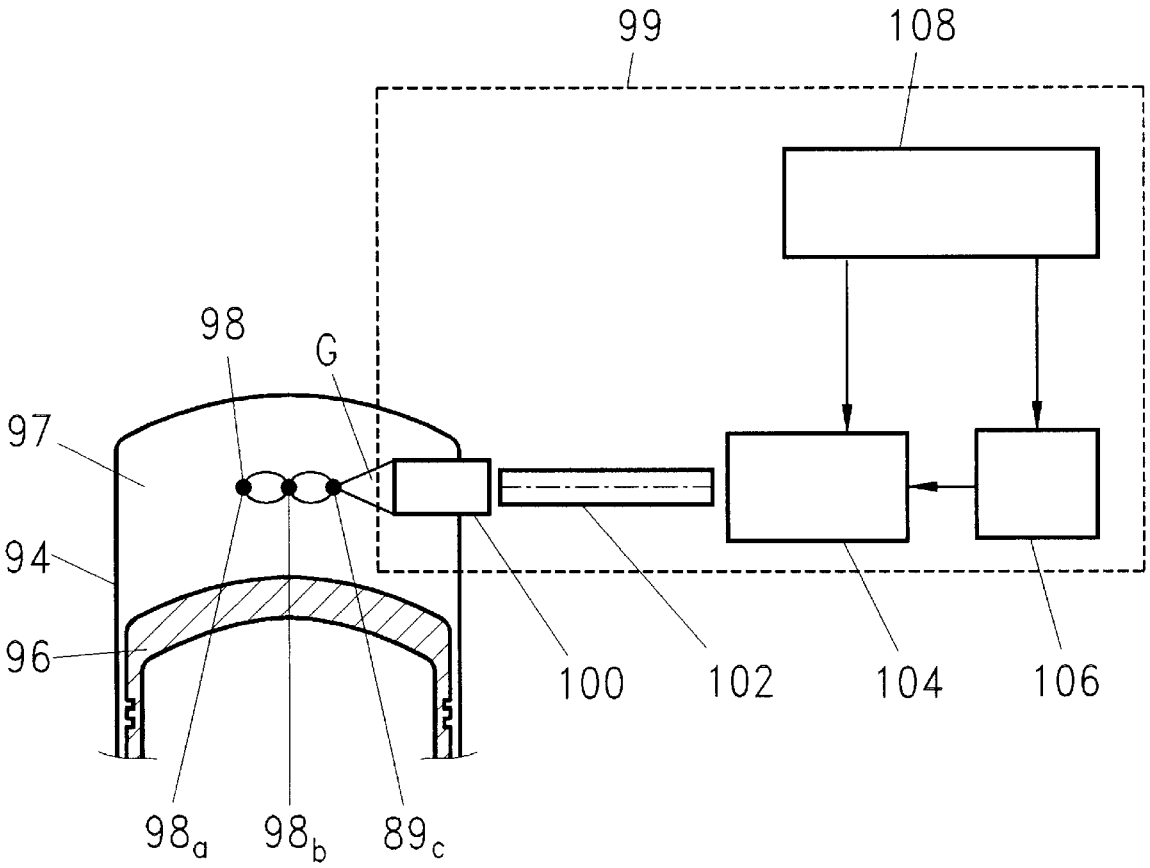
FIG. 7 is a general block-diagram of an ICE ignition system of the invention that combines a laser spark ignition with laser pumping when the same laser is used as a means for both ignition and pumping.

FIGS. 3–7 schematically illustrate the ignition systems of the invention, which differ by the types of igniters and constructions of modulated HF pumping arrangements. More specifically, FIG. 3 represents a general block-diagram of an ICE ignition system that combines an electric spark ignition with modulated MW pumping. FIG. 4 represents a general block-diagram of an ICE ignition system that combines a laser-ignition device with modulated MW pumping. FIG. 5 represents a general block-diagram of an ICE ignition system that combines an electric spark ignition with modulated laser pumping of the kernel. FIG. 6 represents a general block-diagram of an ICE ignition system that combines a laser-ignition device with modulated laser pumping of the kernel. FIG. 7 represents a general block-diagram of an ICE ignition system that combines a laser-ignition device with modulated laser pumping of the kernel when the same laser is used as a means for both ignition and pumping.

The System that Combines Electric Plug Ignition with Modulated MW Pumping

The system shown in FIG. 3 consists of a cylinder 10 and a piston 14 that reciprocates within cylinder 10 and that forms together with cylinder 10 a combustion chamber 11 which at the same time functions as an MW cavity. Cylinder 10 periodically receives a combustion mixture in the same manner as the cylinder of a conventional ICE. An electric ignition plug 12 with an interelectrode gap 13 is installed at the head of cylinder 10 for ignition of a combustible mixture in the combustion chamber in accordance with the operation cycle of the ICE. An MW coupling loop unit 16 is built into a side wall of cylinder 10 and connected to an MW generator 20 for transmitting MW power of this generator to combustion chamber 11 and directing it to interelectrode gap 13 of spark plug 12. An output $\mathbf{20}_o$ of generator 20 is regulated by a built-in amplitude modulation (AM) unit 24 which is connected to an input $\mathbf{20}_I$ of generator 20 and is controlled by a computer 22 via an input $\mathbf{24}_I$. Computer 22 is also connected to an input $\mathbf{26}_I$ of an electric power supply 26 of a spark plug 12.

The system of FIG. 3 operates as follows. When combustion chamber is filled with a fuel mixture, a spark is generated in a conventional manner in interelectrode gap 13 by spark plug 12 in a manner known in the art of internal combustion engines. As a result, an ignition kernel 18 is produced inside interelectrode space 13. Kernel 18 is irradiated with a high-frequency (HF) electromagnetic field (microwave or laser) with an amplitude quasiperiodically modulated with the 10–1000 kHz frequency and introduced into the combustion chamber just within 50–500 μs after ignition. This energy will be absorbed essentially by the electrons in the area of the kernel, whereas the remaining volume of combustion chamber 13 will be transparent to HF radiation. The modulation frequency will be close to the frequency of the kernel shape instability.

Due to thermal inertia, the medium perceives the oscillations on the frequency of modulation, whereby the surface of the kernel is developed and is split into separate fractions. This causes transfer from laminar to turbulent bulk combustion. The technique proposed is of an especially great importance for a lean-burn ICE which is normally characterized by low combustion temperature and hindered transition to turbulent flame propagation.

The System that Combines Laser Ignition with Modulated MW Pumping

FIG. 4 represents a general block-diagram for an ICE ignition system using a combination of a laser spark ignition and MW pumping of the kernel by modulated radiation. The system consists of an ICE cylinder 28 with a piston 30 reciprocating in the cylinder as in a conventional ICE. A combustion chamber 29 formed by cylinder 28 and a piston 30 is simultaneously used as an MW cavity tuned to an HF carrier frequency.

Built into the side wall of the cylinder 28 is a focusing system unit 32 of a laser igniter 33 which consists of a beam-controlled laser unit 36 powered from a laser power supply 38.

Laser unit 36 and a laser power supply 38 are both controlled by a computer 46. Laser igniter 33 is connected to focusing unit 32 through an opto-fiber cable 34. An MW coupling loop unit 40 is built into the head of cylinder 28 and is connected to an MW generator 42 which, in turn, is controlled by a computer 46 via a built-in amplitude-modulation (AM) unit 44.

Unit 44 is a permanent part of any microwave generator. Coupling loops 16 of the pumping system of FIG. 3 and unit 40 of FIG. 4 may be represented by an MW coupling loop disclosed in U.S. Pat. No. 4,499,872. Since our MW pulse contrary to this patent acts for a time much shorter than the cycle time of the engine, the system will be free of complications associated with the cavity detuning under the piston movement intrinsic to aforementioned patent.

Ignition of a combustible mixture in combustion chamber 29 is produced in an optical focus 48 of unit 32 or in several focuses 48*a*, 48*b*, 48*c* under a self-focusing conditions [see, e.g., Phys. Rev. Lett. by Giuliano' C. R., Marburger J. H., 27. p.905, 1971 ] of the laser beam B introduced into the combustion chamber 29 by laser igniter 33 via cable 34 and focusing unit 32. As a result, a kernel or several kernels 48*a*, 48*b*, 48*c* are formed in the bulk of chamber 29 where these kernels can be disintegrated into a plurality of smaller kernel particles (FIGS. 2*d* and 2*e*) by subjecting them to MW pumping with modulated radiation from the assembly consisting of units 40, 42, 44, and 46.

System that Combines Electrical Spark Ignition with Modulated Laser Pumping

FIG. 5 represents a general block-diagram for an ICE ignition system using a combination of an electric spark ignition with a laser pumping of the kernel by modulated radiation. The system consists of an ignition arrangement 53 and a pumping assembly 59. Ignition arrangement 53 includes an electric ignition plug 54 built into the head of cylinder 50. The plug 54 is connected to an electric power supply 56 controlled by a computer 58. Pumping assembly 59 includes a focusing system 62 built into the wall of cylinder 50 and connected via opto-fiber cable 64 with a beam-controlled laser unit 66 powered from a laser power supply 68 controlled by computer 58.

An ignition kernel 60 is produced inside the interelectrode space of ignition electric plug 54. Kernel 60 is irradiated by laser beam D which is focused into the kernel by focusing system 62 through opto-fiber cable 64 from beam control unit 66 powered from laser power supply 68 controlled by computer 58.

System that Combines Laser Ignition and Laser Pumping

FIG. 6 represents a general block-diagram for the ICE ignition system using a combination of a laser spark ignition and a laser pumping of the kernel by modulated radiation. In general, the system is similar to that of previous embodiments and consists of an ICE cylinder 70 with a piston 72 reciprocating in a combustion chamber 83 of the cylinder as in a conventional ICE. More specifically, the system consists of a laser spark ignition group 73 and a laser kernel pumping group 75. Laser spark ignition group 73 includes a focusing system 84 built into the head of cylinder 70 and connected via an opto-fiber cable 86 to a beam-controlled laser unit 88 powered from a laser power supply 90, laser power supply 90 and the laser unit 88 both being controlled by computer 92. Pumping system 75 includes a focusing unit 74 connected via an opto-fiber cable 76 to a beam-controlled laser unit 78 powered from a laser power supply 80, laser power supply 80 and laser unit 78 being both controlled by computer 92.

In this system, ignition of the combustion mixture is produced in an optical focus 82 of the laser beam B introduced into combustion chamber 83. After appearance of kernel 82, laser pumping of a kernel 82 is produced by point focused modulated radiation from laser unit 75. The further process of development of the kernel, as well as its splitting and acceleration of combustion proceeds according to the scheme described in connection with other embodiments of the invention.

System that Combines Ignition and Pumping in One Laser Unit

FIG. 7 illustrates another embodiment of an ignition system of the invention in which the same laser is used for both ignition and pumping the ignition kernel. The system consists of an ICE cylinder 94 with a piston 96 reciprocating in a combustion chamber 97 of the cylinder and a laser arrangement 99 that consists of a focusing unit 100 which is connected to a beam controlled-laser unit 104 via an opto-fiber cable 102. Unit 104 is powered from a laser power supply 106 which are both controlled by computer 108.

In this system, both ignition of combustible mixture and pumping of the ignition kernel are produced in an optical focus 98 or in several focuses 98*a*, 98*b*, 98*c* of the laser beam G introduced into a combustion chamber by focusing system 100 through opto-fiber cable 102 from a beam-controlled laser unit 104.

Focusing systems 32, 62, 74, and 100 mentioned in the aforementioned embodiments may be commercially-produced devices such as focusing beam probes or imaging beam probes manufactured by Oriel Co., GmbH, Germany (Models No 77,646 and 77,651) or opto-fiber devices for multipoint ignition described in Russian Patent No. 2, 003, 825 issued in 1993 to Baranov V. V, et al., (AO-H/7O "Cmeknonnacmuk", Moscow, Russia ). The use of this device is preferable due to a decreased influence of the Mache effect and, as a result, a reduced $NO_x$ emission.

Laser equipment used in the systems of FIGS. 4–7 may be represented by a commercial double-mode Nd-YAG laser with the wavelength of $\lambda$=1.06 $\mu$m, pulse energy of ~0.03 J (Q-switching) and ~0.01 J (ps mode), pulse duration of 10÷20 ns (Q-switching) and ~100 ps (ps mode), and repetition frequency of 100 Hz.

Figure 8:
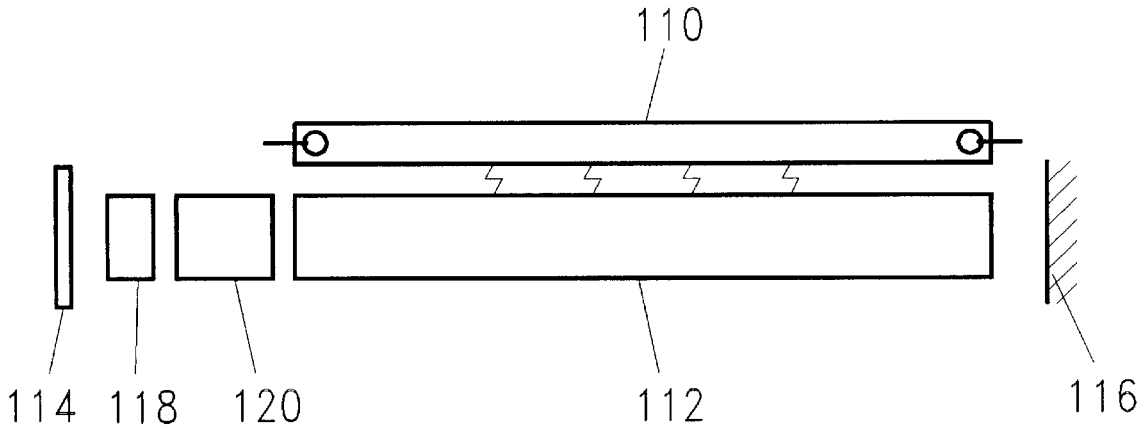
FIG. 8 is a schematic view of a beam-controlled laser unit used in the system of FIG. 7.
Figure 9:
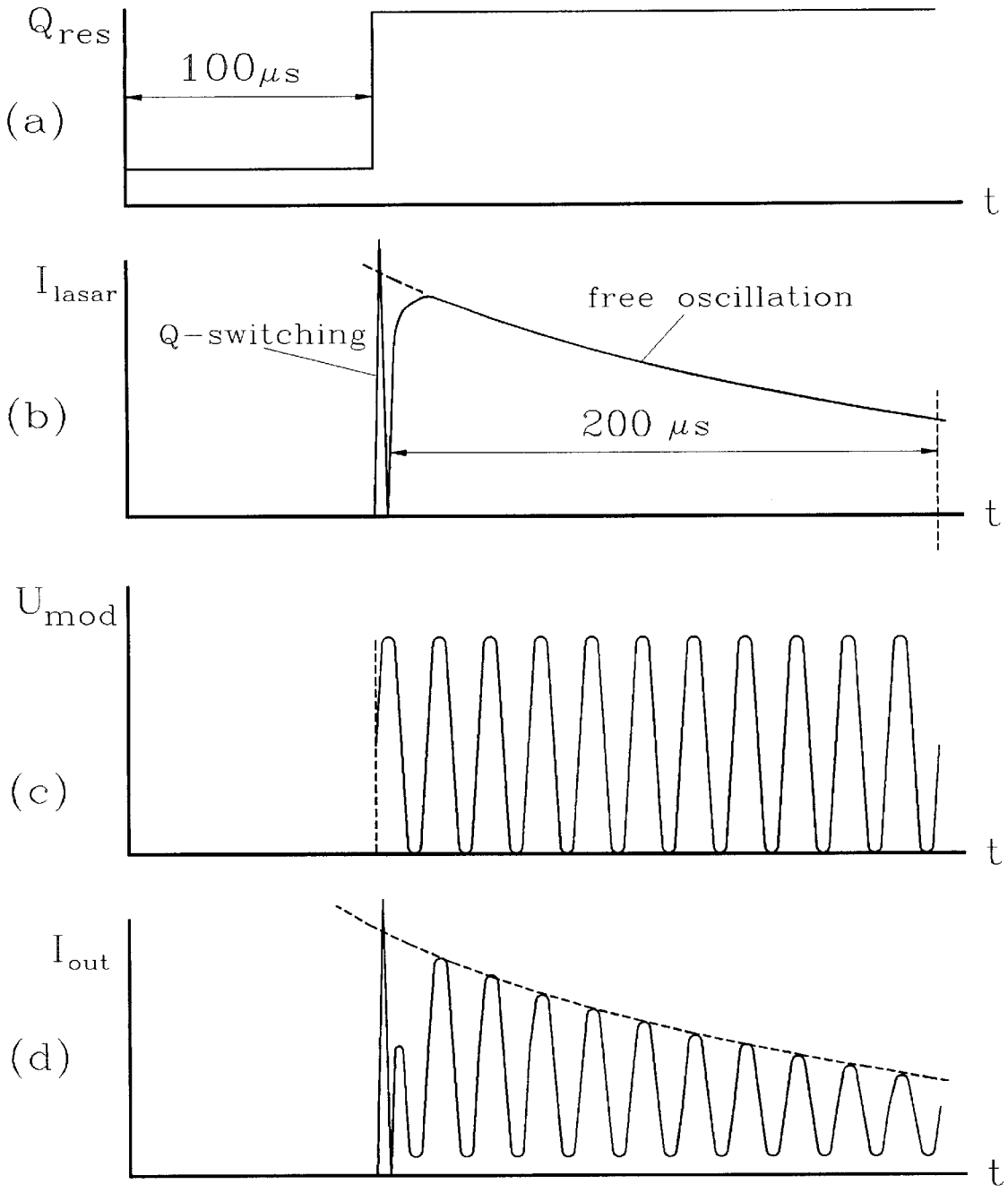
FIG. 9 shows time charts for the explanation of the laser operation in the ignition system of FIG. 7.

FIG. 8 schematically shows the construction of a beam-controlled laser unit 104 of FIG. 7, and FIGS. 9*a*÷9*d* are the time charts for the explanation of the operation of a laser in the embodiment presented in FIG. 7 when the same laser is used as a means for both ignition and pumping the kernel.

Laser assembly of FIG. 8 consists of an active element 112 pumped by a laser lamp 110. The active element is placed between mirrors 114 and 116. An electro-optical modulator 118 and a laser lock 120 are installed between the outlet end of the active element 112 and mirror 114.

The device of FIG. 8 operates as follows. Laser lamp 110 is switched on at the moment t=0 and begins to pump active element 114 about a 50–100 $\mu$s ahead of an ignition. The time t=0 corresponds to the origin of coordinates in charts of FIGS. 9*a*÷9*d*. At the ignition time the Q-factor of a laser resonator formed by mirrors 114 and 116 is switched on by laser lock 120 (FIG. 9*a*). At that moment a Q-switched giant laser pulse appears followed by prolonged free laser oscillation with the characteristic time of about 200 $\mu$s (FIG. 9*b*). This free oscillating pulse is modulated in intensity by electro-optical modulator 118. The voltage signal applied to the modulator is controlled by a computer to have the frequency close to the abovementioned frequency of the kernel instability (FIG. 9*c*). The resulting laser output signal for a modulation frequency of 50 kHz is shown in FIG. 9*d*. The powerful giant laser pulse in the Q-switching mode causes a breakdown in inflammable mixture, whereas repetitive pulses promote a turbulence development and an accelerated transition to a developed turbulent flame propagation, Optical modulation of a free laser oscillation described in the aforementioned laser-ignition system is one of the main distinguishing features of the invention. In contrast to the system of U.S. Pat. No. 4,416,226, where repetitive non-modulated laser pulses are intended only for ignition reliability, optical modulation used in our invention is aimed at the development of turbulence. As a result, it becomes possible to utilize a single laser source as an igniter and a pumping device.

Thus it has been shown that the invention provides an ignition system for an internal combustion engine (ICE) which is simple in construction, reliable in operation, and inexpensive to manufacture. The system of the invention ensures fast transfer from a laminar combustion to a turbulent flame propagation and improve performance of ICE on lean-bum mixtures without worsening other characteristics of the engine.

Although the invention has been shown and described with reference to specific embodiments, it is understood that these embodiments should not be construed as limiting the application of the invention and that any modifications and changes can be made with regard to the materials, shapes, and dimensions of the parts of the invention systems, provided that these modifications do not depart from the scope of the attached claims. For example laser units of types other than those mentioned in the specification can be used for pumping and ignition. The same relates to the elements of the pumping system. For example an antenna system could be applied instead of the loop to transmit MW power to the combustion chamber.

We claim:

1. A method of ignition of a combustible air-fuel mixture in an ignition zone of a combustion chamber of an internal combustion engine having an output shaft, comprising the steps of:

supplying a portion of said air-fuel mixture into said chamber;

igniting said air-fuel mixture to form at least one ignition kernel and to cause laminar burning of said air-fuel mixture in said at least one ignition kernel, said at least one ignition kernel having shape instability during burning, said shape instability having frequency;

irradiating said at least one ignition kernel in early stage of said laminar burning with an additional source of high frequency electromagnetic energy which is periodically amplitude-modulated with the period parametrically dependent on burning time and with the modulation frequency always close to that of said shape instability, thus causing said at least one ignition kernel to split into a plurality of topologically independent parts and accelerating a transfer from said laminar burning to self-sustaining turbulent burning.

2. The method of claim 1, further including the steps of:

selecting parameters of said amplitude-modulated high frequency electromagnetic energy by programmed temporal fine tuning for developing a maximal output power on said output shaft of said engine;

finding an optimum form of a parametric function specific to the type of said engine, operating conditions of said engine, and characteristics of said combustible mixture; and controlling said step of irradiation on the basis of said optimum form.

3. The method of claim 2, wherein said engine has an on-board computer and wherein said step of finding is performed by carrying out bench testing of said engine outside said vehicle and then inputting said optimum form of said parametric function into said on-board computer for carrying out said step of controlling.

4. The method of claim 2, wherein said engine is installed on a vehicle having an on-board computer and wherein said step of finding is performed in a real time by said computer during operation of said engine on the basis of said optimum form of said parametric function.

5. The method of claim 2, wherein said early stage lasts first 50–500 $\mu$s after said igniting.

6. The method of claim 5, wherein said additional energy is microwave radiation which has a modulation frequency within the range of 10 to 1000 kHz.

7. The method of claim 6, wherein said step of igniting is performed with an electric spark.

8. The method of claim 7, wherein said engine has an on-board computer and wherein said step of finding is performed by carrying out bench testing and then inputting said optimum form of said parametric function into said on-board computer for carrying out said step of controlling.

9. The method of claim 7, wherein said engine has an on-board computer and wherein said step of finding is performed in real time by said computer during operation of said engine on the basis of optimum form of said parametric function.

10. The method of claim 5, wherein said step of irradiating with additional energy is irradiating with a laser energy having a modulation-frequency within the range of 10 to 1000 kHz.

11. The method of claim 10, wherein said step of igniting is performed with a laser spark.

12. The method of claim 10, wherein said step of igniting and said step of irradiating are both performed from a single laser.

13. The method of claim 6, wherein said step of igniting is performed with a laser spark.

14. The method of claim 10, wherein said step of igniting is performed with an electric spark.

15. The method of claim 13, wherein said engine has an on-board computer and wherein said step of finding is performed by carrying out bench testing and then inputting said optimum form of said parametric function into said on-board computer for carrying out said step of controlling.

16. The method of claim 13, wherein said engine has an on-board computer and wherein said step of finding is performed in real time by said computer during operation of said engine on the basis of said optimum form of said parametric function.

17. The method of claim 11, wherein said engine has an on-board computer and wherein said step of finding is performed by carrying out bench testing and then inputting said optimum form of said parametric function into said on-board computer for carrying out said step of controlling.

18. The method of claim 11, wherein said engine has an on-board computer and wherein said step of finding is performed in real time by said computer during operation of said engine on the basis of said optimum form of said parametric function.

19. The method of claim 14, wherein said engine has an on-board computer and wherein said step of finding is performed by carrying out bench testing and then inputting said optimum form of said parametric function into said on-board computer for carrying out said step of controlling.

20. The method of claim 14, wherein said engine has an on-board computer and wherein said step of finding is performed in real time by said on-board computer during operation of said engine on the basis of said optimum form of said parametric function.

21. An ignition system for an internal combustion engine having an output shaft, comprising:

an internal combustion engine cylinder and a piston reciprocating in said internal combustion cylinder and forming together with said internal combustion cylinder a combustion chamber for combustion of a combustible fuel mixture, said chamber having an ignition zone where at least one ignition kernel is formed as a result of ignition of said combustible fuel mixture, said at least one kernel having frequency instability; and high frequency electromagnetic energy means for irradiating said at least one ignition kernel at an early stage of combustion, said source of high frequency electromagnetic energy having means for amplitude modulating said high frequency electromagnetic energy quasiperiodically, said early stage lasts 50 to 500 $\mu$sec after ignition.

22. The system of claim 21, further including ignition means for ignition of said combustible fuel mixture.

23. The system of claim 22, wherein said ignition means are incorporated into said high frequency electromagnetic energy means.

24. The system of claim 22 wherein said ignition means are separated from said high frequency electromagnetic energy means.

25. The system of claim 24, wherein said ignition means is an ignition plug installed in said internal combustion engine cylinder, said ignition plug being capable of forming said at least one ignition kernel when said ignition plug is activated, said high frequency electromagnetic means having a source of high frequency electromagnetic energy;

said system further comprising:

a transmitting system built into said internal combustion engine cylinder for directing said additional energy onto said at least one ignition kernel, said transmitting system being connected to said source of high frequency electromagnetic energy; and means for amplitude modulating said high frequency electromagnetic energy quasiperiodically prior to directing said high frequency electromagnetic energy onto said kernel.

26. The system of claim 25, wherein said ignition plug is an electric spark plug and said high frequency electromagnetic energy is microwave energy having a modulation frequency of 10 to 1000 kHz, said combustion chamber being simultaneously a microwave cavity tuned to a high frequency carrier frequency of said high frequency electromagnetic energy.

27. The system of claim 26, wherein said transmitting system is a microwave coupling loop unit built into said internal combustion engine cylinder, said source of high frequency electromagnetic energy being a microwave generator connected to said coupling loop; and said means for amplitude modulating being an amplitude modulation unit which is connected to said microwave generator.

28. The system of claim 27, further including an electric power source connected to said electric ignition plug and a programmed means for controlling operation of said amplitude modulation unit, said programmed means being connected to said electric power source and to said amplitude modulation unit.

29. The system of claim 25, wherein said ignition plug is a laser spark plug and said high frequency electromagnetic energy is a microwave energy having a modulation frequency of 10 to 1000 kHz, said combustion chamber being simultaneously a microwave cavity tuned to high frequency carrier frequency of said high frequency electromagnetic energy, said combustion chamber being simultaneously a microwave cavity tuned to high frequency carrier frequency of said high frequency electromagnetic energy.

30. The system of claim 29, further including a laser focusing unit connected to said laser spark plug, a beam-controlled laser unit, an opto-fiber cable connecting said beam-controlled laser unit with said laser focusing unit, a laser power supply unit connected to said beam-controlled laser unit, a computer connected to said beam-controlled laser unit and to said laser power supply unit, said source of high frequency electromagnetic energy comprising a microwave generator, said means for amplitude modulating said high frequency electromagnetic energy, and a microwave loop unit built into said internal combustion engine cylinder.

31. The system of claim 25, wherein said ignition plug is an electric spark plug built into said internal combustion engine cylinder and said source of high frequency electromagnetic energy is laser pumping unit.

32. The system of claim 31, further comprising an electric power supply connected to said electric spark plug, said laser pumping unit comprising a laser focusing unit built into said internal combustion engine cylinder for focusing a laser beam onto said at least one kernel, a beam-controlled laser unit, an opto-fiber cable connecting said focusing unit with said beam-controlled laser unit, and a laser power supply unit connected to said beam-controlled laser unit.

33. The system of claim 32, further including a computer connected to said beam-controlled laser unit, said laser power supply unit, and said electric power supply of said electric spark plug for controlling operation thereof.

34. The system of claim 25, wherein said ignition plug is a laser spark plug and said source of high frequency electromagnetic energy is laser pumping unit.

35. The system of claim 34, further provided with an ignition laser focusing unit built into said internal combustion engine cylinder for producing an optical focus of an ignition laser beam in said combustion chamber, a first beam-controlled laser unit connected to said ignition laser focusing unit; a first opto-fiber cable connecting said ignition laser focusing unit with said first beam-controlled laser unit; a laser power supply unit connected to said first beam-controlled laser unit, a computer connected to said first beam-controlled laser unit and to said laser power supply unit for controlling operation thereof, a pumping laser beam focusing unit built into said internal combustion engine cylinder for producing an optical focus of a laser beam of said high-frequency electromagnetic energy, a second beam-controlled laser unit connected to said pumping laser beam focusing unit, a second opto-fiber cable connecting said pumping laser beam focusing unit with said second beam-controlled laser unit, a second laser power supply unit connected to said second beam-controlled laser unit, said second power supply unit and said second beam-controlled laser unit being connected to said computer.

36. The system of claim 23, wherein said high frequency electromagnetic energy means which incorporates said ignition means is a laser arrangement which comprises: a laser focusing unit built into said internal combustion engine cylinder for focusing a laser beam onto said at least one kernel; a beam-controlled laser unit; an opto-fiber cable connects said laser focusing unit to said beam-controlled laser unit; a laser power supply connected to said beam-controlled laser unit; and a computer connected to said beam-controlled laser unit and said laser power supply unit; said beam-controlled laser unit being a double-mode laser unit having means for generating an ignition laser beam and said high frequency electromagnetic energy in the form of a laser beam which is amplitude modulated quasiperiodically.

37. The system of claim 36, wherein said double-mode laser unit comprises: an active element and a laser lamp arranged in parallel with said laser element for optical pumping said active elements; a first mirror and a second mirror between which said active element is placed; an electro-optical modulator located between said first mirror and said active element; and a laser lock located between said electro-optical modulator and said active element.

38. The system of claim 37, wherein said double-mode laser unit having means for generating a giant laser pulse directed into said internal combustion chamber followed by prolonged free laser oscillation beam focused by said laser focusing device onto said at least one kernel and modulated in intensity by said electro-optical modulator with a frequency close to said frequency instability.

* * * * *